US006435761B1

(12) United States Patent
Bligh et al.

(10) Patent No.: US 6,435,761 B1
(45) Date of Patent: Aug. 20, 2002

(54) SLOT GUARD FOR SLOTTED RAIL TERMINAL

(75) Inventors: Roger P. Bligh, Bryan; King K. Mak, San Antonio; Hayes E. Ross, Jr., College Station, all of TX (US)

(73) Assignee: Texas A&M University System, College Station, TX (US)

( * ) Notice: Subject to any disclaimer, the term of this patent is extended or adjusted under 35 U.S.C. 154(b) by 0 days.

(21) Appl. No.: 09/565,425

(22) Filed: May 5, 2000

Related U.S. Application Data

(60) Provisional application No. 60/132,646, filed on May 5, 1999.

(51) Int. Cl.[7] ..... E01F 13/00; E01F 15/00

(52) U.S. Cl. ..... 404/6; 404/9; 256/13.1

(58) Field of Search ..... 404/6, 9, 10, 11; 256/13.1, 1; 403/334, 409

(56) References Cited

U.S. PATENT DOCUMENTS 1,093,023 A * 4/1914 Alta ..... 403/334
4,928,928 A * 5/1990 Buth et al. ..... 256/13.1
5,022,782 A * 6/1991 Gertz et al. ..... 404/6
5,282,637 A * 2/1994 McCreadie ..... 296/203
5,407,298 A 4/1995 Sicking et al.
5,503,495 A 4/1996 Mak et al.
5,547,309 A * 8/1996 Mak et al. ..... 404/6
5,555,687 A * 9/1996 Logan et al. ..... 52/288.01
5,797,591 A * 8/1998 Krage ..... 256/13.1
5,851,005 A * 12/1998 Muller et al. ..... 256/13.1
6,116,805 A * 9/2000 Gertz ..... 403/13.1

* cited by examiner

*Primary Examiner*—Thomas B. Will
*Assistant Examiner*—Raymond W Addie
(74) *Attorney, Agent, or Firm*—Shawn Hunter; Bracewell & Patterson L.L.P.

(57) ABSTRACT

Slot guards for a slotted rail terminals are described having a central section and a pair of wing portions that are angularly disposed with respect to the central portion. The wing portions are folded away from the plane of the central section along lines that are angularly oriented with respect to one another so that the wing portions are wider at one end of the slot guard than at the other end. As a result, the slot guard provides a greater height at one of its ends than at the other end. Apertures for connectors are disposed through each of the wing portions, but not through the central portion. The slot guard preferably provides an asymmetrical aperture pattern and/or conspicuous markings so that the slot guard is not inadvertently installed in a reversed configuration on a guardrail. Methods for forming the slot guard are also described wherein a blank for a slot guard is cut or stamped out of a sheet of metal. Apertures for the receipt of connectors are cut into the blank, preferably in an asymmetrical pattern. Longitudinal sides of the blank are then bent along non-parallel lines to provide the wing portions.

19 Claims, 3 Drawing Sheets

SLOT GUARD FOR SLOTTED RAIL TERMINAL

CROSS-REFERENCE TO RELATED APPLICATIONS

This application claims the priority of U.S. Provisional Application No. 60/132,646 filed May 5, 1999.

BACKGROUND

1. Field of the Invention

The present invention generally relates to an improvement for a slotted rail terminal (SRT) and the slot guards used therewith to enhance the safety performance of the SRT during vehicular impacts along the length of the terminal. Primary purposes of a slot guard are to prevent tearing and failure of the guardrail at the downstream end of the rail slots as well as to assist redirection of vehicle components.

2. Description of the Related Art

SRT devices are described in U.S. Pat. No. 5,407,298 entitled "Slotted Rail Terminal" issued Apr. 18, 1995; U.S. Pat. No. 5,547,309 entitled "Thrie-Beam Terminal with Breakaway Post Cable Release," issued Aug. 20, 1996; and U.S. Pat. No. 5,503,495 entitled "Thrie-Beam Terminal with Breakaway Post Cable Release," issued Apr. 2, 1996. All of these patents have been assigned to the assignee of the present invention, and all of these patents are incorporated herein by reference.

The original SRT utilized slot guards to maintain rail integrity during lateral impacts along the length of the terminal without affecting the buckling of the slotted rail in end-on impacts. One prominent feature of the original slot guard was a welded deflector plate that angled away from the back side of the slot guard and rail near the downstream end of a central slot of the guardrail. The primary purpose of the deflector plate was to prevent the bumper or other portions of the impacting vehicle from extending the slots by pushing the rail out and away from the penetrating vehicle, and helping to redirect the vehicle back into traffic.

While the original design for the slot guard has performed well, improvements are desired that would enhance the impact performance of the SRT system and reduce manufacturing and installation cost. For example, the prior slot guard incorporated a deflector plate that was welded onto the slot guard body. As a result, welding of the deflector has become a necessary step in forming the slot guard, thereby resulting in additional manufacturing costs.

In addition, the deflector portion for the standard slot guard protrudes outwardly from the central section, and the plane of the rail member, at a relatively sharp angle. The deflector portion also extends over only a small portion of the entire length of the slot guard. These features are believed by the inventors to be somewhat inefficient for redirection of vehicular components.

Also, one or more connectors are disposed through the central section of the standard slot guard. The inventors have recognized that the presence of connectors disposed through the central portion presents a potential obstacle that could snag portions of vehicles.

An improved slot guard design would be desirable.

SUMMARY OF THE INVENTION

The present invention provides devices and methods that enhance impact performance and reduce manufacturing and installation costs. An improved slot guard is described that has a central section and a pair of wing portions that are angularly disposed with respect to the central portion. The wing portions are folded away from the plane of the central section along lines that are angularly oriented with respect to one another so that the wing portions are wider at one end of the slot guard than at the other end. As a result, the slot guard provides a greater height at one of its ends than at the other end.

In operation, the inventive slot guard provides improved portions that assist in deflecting vehicle components. The deflector surface of the inventive slot guard extends along the entire length of the slot guard. In addition, the deflector surface departs from the plane of the rail member at a much more gentle angle than was the case with previous slot guards.

Apertures for connectors are disposed through each of the wing portions, but not through the central portion. The exemplary slot guard preferably provides an asymmetrical connector pattern and/or conspicuous markings so that the slot guard is not inadvertently installed in a reversed configuration on a guardrail.

Methods for forming the slot guard are also described wherein a blank for a slot guard is cut or stamped out of a sheet of metal. Apertures for the receipt of connectors are cut into the blank, preferably in an asymmetrical pattern. Longitudinal sides of the blank are then bent along non-parallel lines to provide the wing portions.

DETAILED DESCRIPTION OF THE PREFERRED EMBODIMENTS

Figure 1:
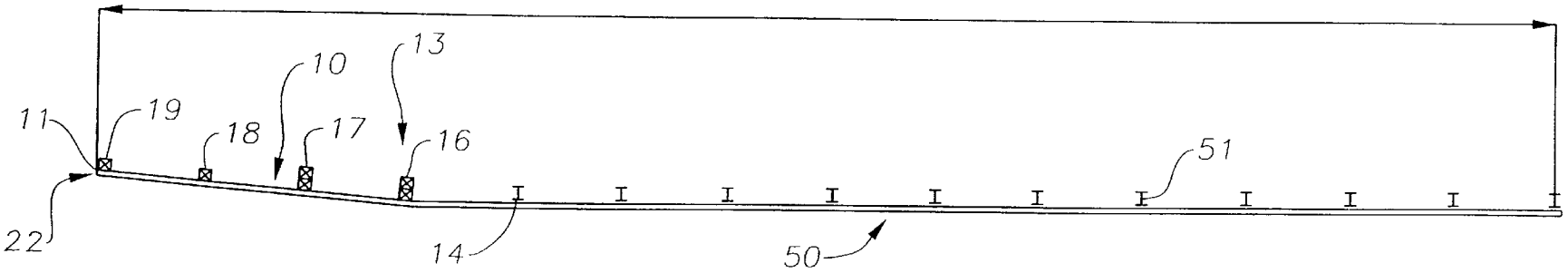
FIG. 1 is a plan view of an exemplary slotted rail terminal constructed in accordance with the present invention.
Figure 2:
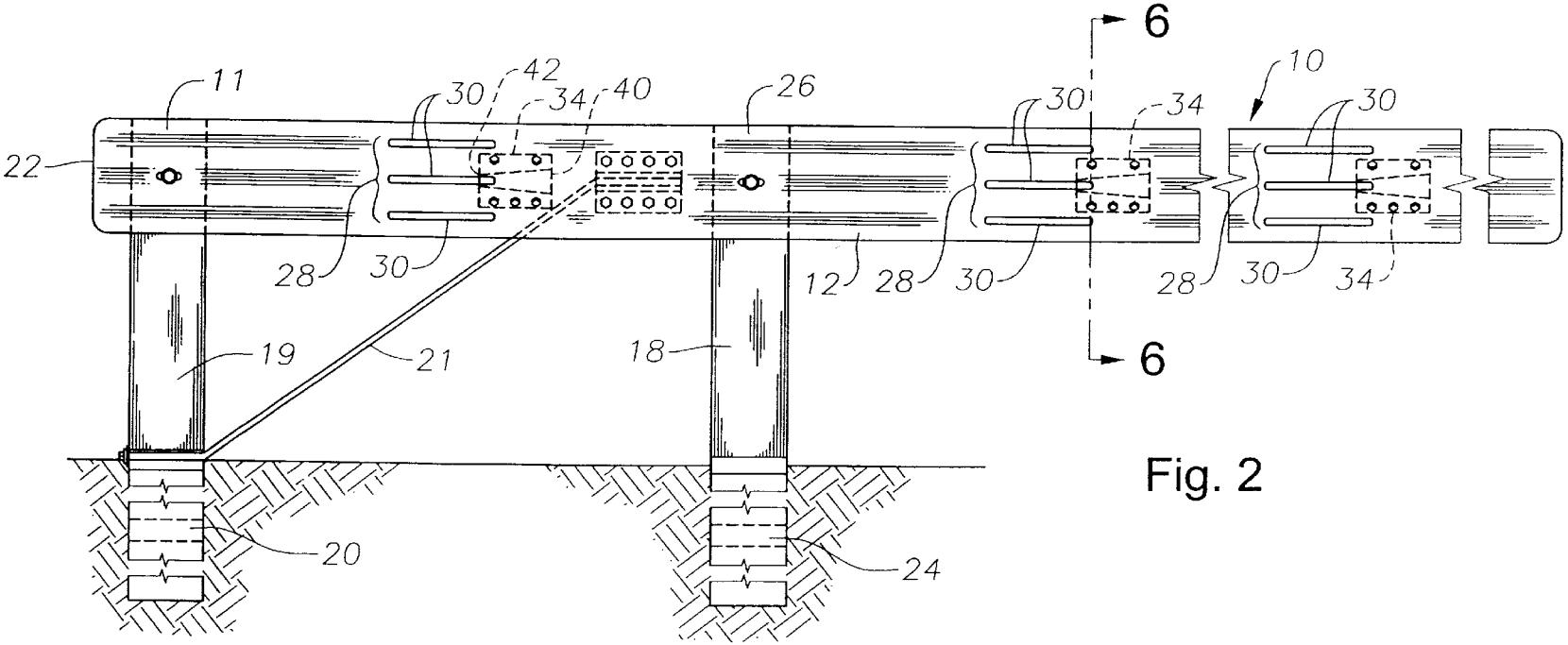
FIG. 2 is a side view of the upstream portion of the slotted rail terminal of FIG. 1.

Referring first to FIGS. 1 and 2, the guardrail terminal 10 is shown that includes a section of corrugated guardrail 12 mounted on one or more support posts 16, 17, 18 and 19. As shown, terminal 10 is employed in a preferred embodiment as end terminal for a conventional guardrail assembly 50, which in turn is supported by support posts or stakes 51. As shown in FIG. 2, the corrugated (or W-beam) guardrail 12 of the present invention preferably includes a series of multiple slotted zones 28 longitudinally spaced along the rail 12. As depicted in FIG. 2, it is preferred that each of the slotted zones 28 be approximately centered between or placed at quarter-distance points between the support posts 16, 17, 18 and 19. It will be understood, however, that the spacing and location of the slotted zones may be varied as desired. The slotted zones 28 comprise one or more slots 30 longitudinally disposed in the W-beam guardrail 12. The use of three slots has proven effective in testing models of guardrails constructed similar to terminal 10, but the number of slots may vary depending upon the type of guardrail member 12 used and the desired energy dissipation characteristics.

Figure 6:
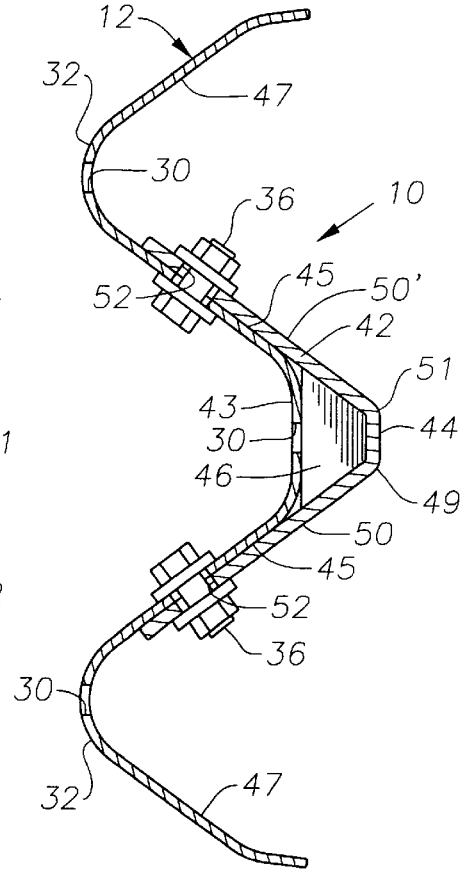
FIG. 6 is a cross-section taken along lines 6—6 in FIG. 2, illustrating attachment of an exemplary slot guard to a corrugated rail.

A preferred placement of slots 30 within slotted zones 28 is described in detail in U.S. Pat. No. 5,407,298 and can be better understood with reference to the cross-section for a typical W-beam guardrail 12 as shown in FIG. 6. A valley 43 is positioned between upper and lower peaks 32 and is formed at the intersections of inclined web portions 45. Edge members 47 laterally outlie each peak 32. Highly preferred placement for slots 30 is proximate each peak 32 and the valley 43. The slots 30 should be of a size sufficient to reduce the ability of the rail to resist buckling in response to a longitudinal loading from one end of rail. Effective sizes for slots have been found to be approximately ½in. in width and a minimum of 12 inches in length. However, shorter slots or slots of varied lengths might also be effective.

The dynamic buckling strength of the guardrail terminal can be tuned to any desirable level by controlling the number and length of slots 30. Generally, larger and longer slots have reduced dynamic buckling strength to a greater degree as has a greater number of slots. The number and length of slots can be selected to sufficiently reduce the buckling strength of the rail to safely accommodate impacts by different sizes of vehicles.

The slotted guardrail terminal 10 preferably includes one or more support posts 16,17, 18 and 19. The terminal 10 features an upstream portion 11 and a more downstream portion 13 with the upstream portion 11 disposed relative to the expected direction of traffic and longitudinally disposed loadings on the rail from end on impacts. Downstream portion 13 is preferably adapted to be fixedly connected to the adjoining conventional guardrail assembly 50 by means of bolts, rivets, or other known connection means. The posts 18 and 19 are preferably breakaway posts made of a material which is substantially frangible upon impact by a vehicle. Posts 18 in 19 may comprise 6 in. by 8 in. rectangular wooden posts or breakaway steel posts embedded in concrete 24 in the soil or ground 20. In an alternative embodiment, the posts 18 in 19 may be placed into vertically positioned steel foundation tubes of a type generally known in the art. A tension cable assembly 21, of a type known in the art, extends through the lead support post 19 and is affixed to the rail member 12.

It is noted that the guardrail terminal 10 presents an "upstream" end 22, the term "upstream" referring to the general direction from which traffic might be expected to approach, and therefore impact, the guardrail terminal 10. In other words, an end-on impact to the guardrail terminal 10 would most likely occur at the upstream end 22. At a more downstream point, the slotted rail terminal may be supported by conventional support posts 16 and 17 of more substantial wood, metal or other material. The guardrail 12 may be affixed to the posts 16,17, 18 and 19 by fasteners 26 such as bolts.

Figure 3:
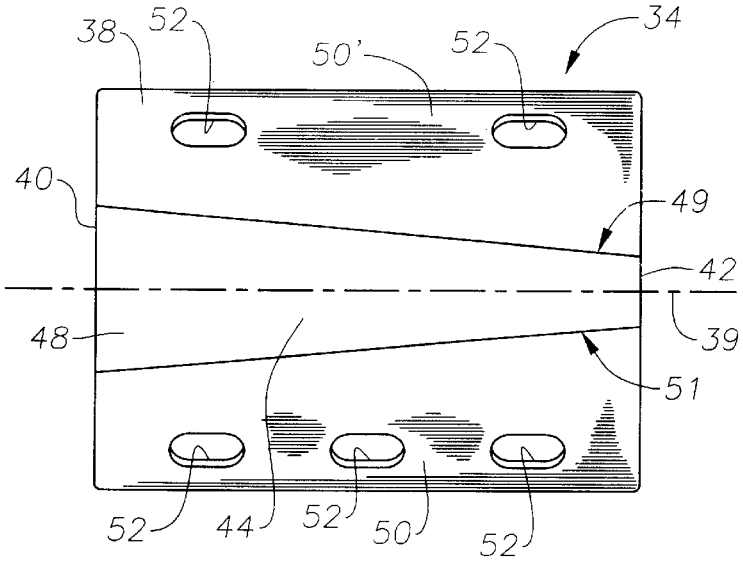
FIG. 3 is a top view of an exemplary slot guard constructed in accordance with the present invention.
Figure 4:
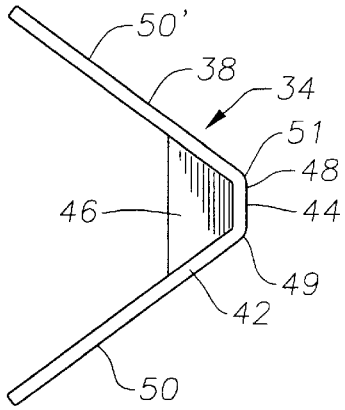
FIG. 4 is an end view of the slot guard shown in FIG. 3.

A novel slot guard 34 is shown in FIGS. 3–6 that is adapted to be attached to the guardrail 12 proximate the downstream end of each slotted zone 28 by the use of fasteners 36 shown in FIG. 6. The slot guard 34 has a body 38 which defines a longitudinal axis 39, which is shown in FIG. 3. The body 38 has a downstream end 40 and an upstream end 42. The body 38 of the slot guard 34 includes a central portion 44 having a substantially flat outer surface 48 and an inner surface 46. The inner surface 46 extends along the entire length of the body 38 and provides a deflector surface that is intended to engage vehicle portions that enter the downstream portion of the central slot 30 of the rail member 12. It is noted that the central portion 44 has no apertures in it for placement of connectors, thereby allowing the deflector surface 46 to remain continuous and unbroken by apertures.

Two wing portions 50, 50' laterally outlie the central portion 44 and angularly diverge from the plane of the central portion 44. It is noted that the wing portions are bent angularly along joints, or bend lines, 49, 51 that depart angularly from the longitudinal axis 39. A currently preferred angle of departure for the joints 49, 51 is approximately 5 degrees. The joints of bending for previous slot guard designs were, on the other hand, substantially parallel with the each other and with the longitudinal axis of the slot guard.

Figure 5:
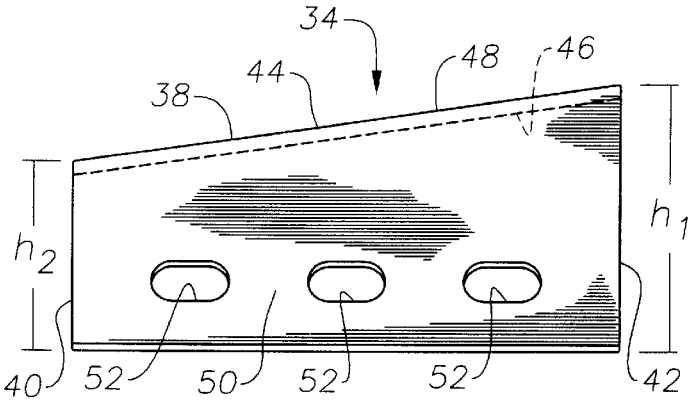
FIG. 5 is a side view of the slot guard constructed in accordance with the present invention.

Due to the angle of the joints 49, 51 from the axis 39, the central portion 44 decreases in width as it approaches the upstream end 42. Conversely, the wing portions 50, 50' increase in width as they approach the upstream end 42. As can be seen in FIG. 5, the upstream end 42 of the body 38 therefore has a greater height "$h_1$." as measured from the top of the central portion 44, than the downstream end 40 "$h_2$." Currently preferred dimensions are 97.5 mm for $h_1$, and 70.5 mm for $h_2$. It is further pointed out that the height of the slot guard 34 increases continuously from the downstream end 40 toward the upstream end 42. As a result, the deflector surface 46 provides a surface that is angled upwardly continuously from the downstream end 40 to the upstream end 42.

There are bolt holes, or apertures, 52 disposed in each of the wing portions 50, 50' that are shaped and sized to receive a connector, such as the nut-and-bolt type connector illustrated in FIG. 6. The pattern of bolt holes 52 is deliberately asymmetrical (as shown in FIG. 3) in order to prevent the slot guard 34 from being inadvertently installed in a reversed position on the guardrail 12 (i.e., where the upstream end 42 and downstream end 40 are reversed). In practice, for example, installers would be instructed to always attach the slot guard 34 to a rail member 12 with the upstream end 42 of the slot guard 34 facing the slot 30. In the exemplary design illustrated, there are three apertures 52 disposed through the wing portion 50 while only two apertures 52 are disposed through the other wing portion 50'. Thus, the pattern of bolt holes 52 on one wing portion 50 does not mirror the pattern of bolt holes 52 on the other wing portion 50'. The body 38 may also be appropriately marked with arrows and/or annotations to help insure that the slot guard 34 is not inadvertently reversed in position when installed. It can be seen then, that the use of asymmetrical aperture patterns or written markings provides visible indicia on the slot guard 34 to help prevent improper installation of the slot guard 34 onto the rail member 12.

As can be seen from FIGS. 2 and 6, the slot guard 34 is installed onto a rail member 12 by disposing each of the wing portions 50, 50' on opposite sides of the valley 43, as illustrated in FIG. 6. Slot guards 34 are affixed by connectors 52 to the rail member 12 proximate the downstream end of each slotted section 28, the term "downstream end " referring to the end of the slotted section 28 that is furthest away from the upstream end 22 of the guardrail terminal 10. When so situated, the downstream end 40 of each slot guard 34 lies substantially flush against the valley 43 of the rail 12. The upstream end 40 of the body 38, however, stands out away from the valley 44, as FIG. 6 illustrates. As a result, the upstream end 42 of each slot guard 34 projects outwardly from the rail member 12, thereby angling the central portion 44 and deflector surface 46 of the slot guard 34 outwardly away from the surface of the rail member 12. In currently preferred embodiments, the central portion 44 departs from the plane of the surface of the rail 12 at an angle of 7.1 degrees.

In operation, the surface 46 of the slot guard 34 acts as a continuous deflector surface that extends along the entire length of the slot guard body 38. Thus, the central portion 44 assist in repositioning vehicle components, particularly those components that have protruded into a slot 30, back onto the outer surface of the rail 12. This repositioning reduces the probability of such components extending the downstream end of the slots 30, which could result in rupture of the rail member 12. The fact that the entire length of the slot guard 34 provides a continuous deflector surface also increases the efficiency of the slot guard 34 in repositioning, as compared to previous slot guards, such as those described in U.S. Pat. Nos. 5,407,298; 5,547,309 and 5,503,495, which provided a shorter deflector surface that departed from the rail surface at a much greater angle.

Operational testing of the inventive slot guards have shown that these devices are effective in preventing excessive tearing of the slotted sections of slotted rail terminals as well as assisting the redirection of portions of laterally impacting vehicles.

A slot guard 34, as described above, may be easily manufactured with a minimum of process steps. First, a blank is cut, stamped or sheared from a sheet of metal. The blank is rectangular or trapezoidal in shape and preferably has dimensions of 9¼"(width)×8½" (length) for the rectangular embodiment. The blank is preferably a flat piece of metal 3/16" in thickness. Apertures 52 are then punched into the blank. If desired, these two steps may be combined so that the apertures 52 are created in the same cutting step during which the blank is cut. Next, the blank is bent along joints 49, 51 to form the wing portions 50, 50'. This step is facilitated by the use of a brake press having a hardened base piece (not shown) over which the blank is placed. The base piece is shaped to provide a template along which the joints 49, 51 may be bent. Bending forces are then applied to the edges of the blank to cause the wing portions 50, 50' to be bent along the joints. No welding is required.

Figure 7:
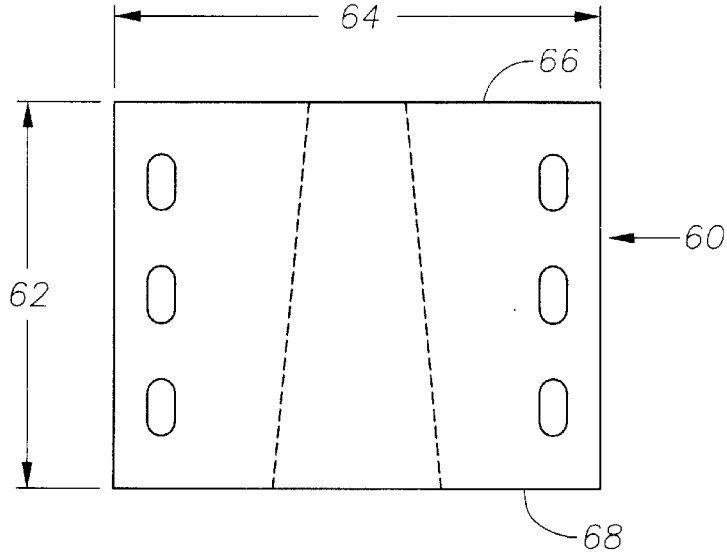
FIG. 7 depicts an exemplary rectangular blank that may be used to fashion a slot guard of the type shown in FIGS. 3–6.
Figure 8:
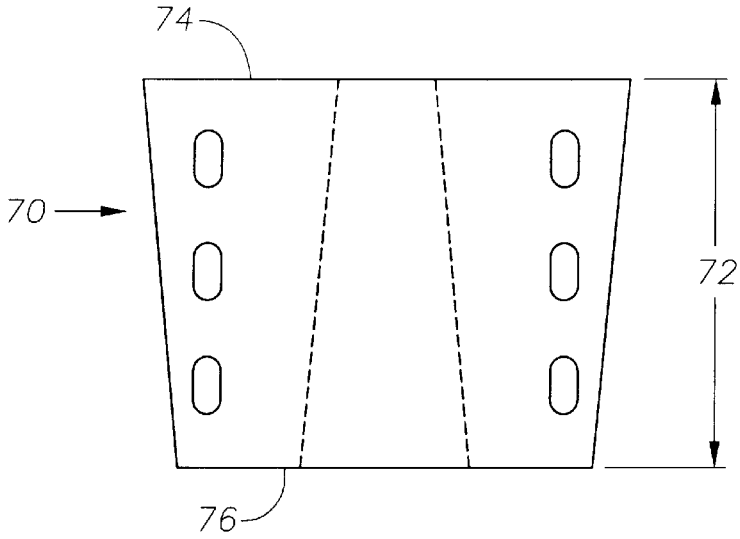
FIG. 8 depicts an exemplary trapezoidal blank that may be used to fashion a slot guard.
Figure 9:
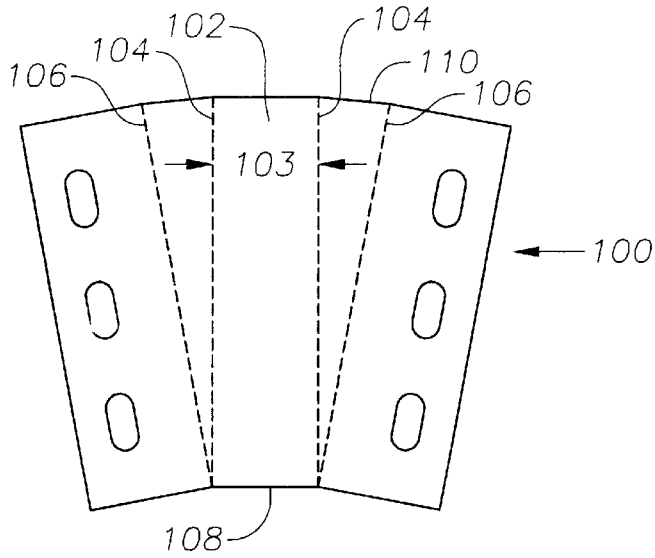
FIG. 9 illustrates a further blank that may be used to fashion a slot guard.

Referring now to FIGS. 7–9, several exemplary blanks are illustrated that may be fashioned into slot guards. FIG. 7 shows a flat blank 60 having a substantially rectangular shape and which may be used to fashion a slot guard of the type shown in FIGS. 3–6. The exemplary blank 60 has a length 62 of 8½" and a width 64 at both longitudinal ends 66, 68 of 9¼".

FIG. 8 illustrates an exemplary trapezoidal, flat blank 70 that may be used to form a slot guard. The blank 70 has a length 72 of 8½". However, one end 74 (the upstream end) has a width of 9¼" while the other (downstream) end 76 has a width of only 8½". The trapezoidal shape ensures that the upstream end 74 of the slot guard formed will have a greater height, as compared to the downstream end 76 than a slot guard formed from a rectangular blank.

FIG. 9 shows a further exemplary blank 100 that may be used to form a slot guard having a central portion 102 of constant width 103. As can be seen from FIG. 9, there are two pairs of bend lines 104, 106. The first pair of bend lines 104 bounds the central portion 102 and are parallel to one another. The second pair 106 adjoins the first pair of bend lines 104 at the downstream end 108 and departs angularly outwardly from the first pair 104 as the upstream end 110 is approached.

It is noted that although the exemplary slot guards have been described as being used with a standard W-beam type rail member 12, those of skill in the art will understand that other types of rail members may be used. For example, a "thrie-beam" rail member, such as described in U.S. Pat. No. 5,547,309, may be used, as well as the Buffalo-style or "O"-rail. Further, while the invention has been shown or described in only some of its forms, it should be apparent to those skilled in the art that it is not so limited, but is susceptible to other various changes without departing from the scope of the invention.

What is claimed is:

1. A slot guard for use with the rail of a slotted rail terminal device, comprising:

a body with a first end and a second end;

the body having a central portion disposed in a plane, the central portion having sides that narrow in width from the first end to the second end; and two wing portions that laterally outlie the central portion and diverge angularly from the plane of the central portion.

2. The slot guard of claim 1 wherein the central portion provides a substantially continuous deflector surface and is not broken by apertures.

3. The slot guard of claim 1 further comprising a plurality of apertures disposed within the wing portions to permit connectors to be disposed therethrough.

4. The slot guard of claim 3 wherein the apertures on each wing portion form a pattern and the pattern of apertures on one of the two wing portions does not mirror the pattern of apertures on the other of the two wing portions.

5. The slot guard of claim 1 wherein the body provides a first height at the first end and a second height at the second end, the first height being lesser than the second height, and the height of the body increases continuously along the length of the body from the first height to the second height.

6. The slot guard of claim 5 wherein the first height is approximately 70.5 mm.

7. The slot guard of claim 6 wherein the second height is approximately 97.5 mm.

8. A slot guard for use with a slotted rail terminal comprising:

a body for contacting and being affixed to a slotted rail member, the body having a first longitudinal end and a second longitudinal end;

the body having a pair of laterally outlying wing portions having inner surfaces that are disposed upon and secured to the slotted rail member;

the body further having a central portion defined between the wing portions, the central portion providing a deflector surface that extends from the first longitudinal end of the body to the second longitudinal end of the body, the deflector surface being disposed angularly away from the rail member when the inner surfaces of the wing portions are affixed to said slotted rail member.

9. The slot guard of claim 8 wherein the angle at which the deflector surface is disposed with respect to the rail member is approximately 7 degrees.

10. The slot guard of claim 8 wherein the deflector surface decreases in width from the first end of the body to the second end.

11. The slot guard of claim 8 wherein the deflector surface has a constant width from the first end of the body to the second end.

12. The slot guard of claim 8 wherein the deflector surface is substantially continuous and contains no apertures.

13. A slotted rail terminal for use at the end of a guardrail, comprising:

a corrugated rail member being disposed in a generally vertical plane along a roadway;

at least one longitudinal slot disposed within the rail member;

a slot guard affixed to the rail member proximate the slot, the slot guard comprising:

a) a body for contacting and being affixed to the rail member, the body having a first longitudinal end and a second longitudinal end b) the body having a pair of laterally outlying wing portions having inner surfaces that are disposed upon and secured to the slotted rail member; and c) the body having a central portion defined between the wing portions, the central portion providing a deflector surface that extends from the first longitudinal end of the body to the second longitudinal end of the body, the deflector surface being disposed continuously angularly away from the plane of the rail member when the inner surfaces of the wing portions are affixed to the rail member.

14. The slotted rail terminal of claim 13 wherein the body of the slot guard having a first height at the first end and a second height at the second end, the first height being lesser than the second height.

15. The slotted rail terminal of claim 13 wherein the slot guard carries visible indicia to help prevent the slot guard from being improperly installed on the rail member.

16. The slotted rail terminal of claim 13 wherein the central portion of the slot guard narrows in width from the first end to the second end.

17. The slotted rail terminal of claim 13 wherein the slot guard body has wing portions that narrow in width from the first end to the second end.

18. The slotted rail terminal of claim 13 wherein the slot guard is formed from a trapezoidal blank.

19. The slotted rail terminal of claim 13 wherein the slot guard is formed from a substantially rectangular blank.

* * * * *

UNITED STATES PATENT AND TRADEMARK OFFICE

CERTIFICATE OF CORRECTION

PATENT NO. : 6,435,761 B1
APPLICATION NO. : 09/565425
DATED : August 20, 2002
INVENTOR(S) : Roger P. Bligh et al.

It is certified that error appears in the above-identified patent and that said Letters Patent is hereby corrected as shown below:

Title Page, at (73) Assignee:
Delete "Texas A&M University System" and insert -- The Texas A&M University System --.

Signed and Sealed this

First Day of July, 2008

JON W. DUDAS
*Director of the United States Patent and Trademark Office*